United States Patent [19]

Moore

[11] Patent Number: 4,712,725

[45] Date of Patent: Dec. 15, 1987

[54] CONTAINER WITH INTEGRAL FOLD-IN CLOSURE LID

[76] Inventor: Timothy J. Moore, 301 Diamond, Redondo Beach, Calif. 90277

[21] Appl. No.: 908,245

[22] Filed: Sep. 17, 1986

[51] Int. Cl.[4] ..... B65D 1/00

[52] U.S. Cl. ..... 229/8; 229/41 C; 229/1.5 B

[58] Field of Search ..... 229/8, 193, 1.5 B, 124, 229/902, 41 B, 43

[56] References Cited

U.S. PATENT DOCUMENTS

| | | | |
|---|---|---|---|
| 3,071,308 | 3/1958 | Lange | 229/37 |
| 3,109,574 | 11/1963 | Lange | 229/37 |
| 3,253,767 | 5/1966 | Pellaton | 229/41 C |
| 3,526,352 | 9/1970 | Swett | 229/39 |
| 3,799,425 | 3/1974 | Fanter | 229/8 |
| 3,809,310 | 5/1974 | Vanderlugt, Jr. | 229/26 |
| 3,901,431 | 8/1975 | Carlson | 229/41 C |
| 3,977,594 | 8/1976 | Swan | 229/41 C |
| 4,177,917 | 12/1979 | Webinger | 229/34 HW |
| 4,199,098 | 4/1980 | Lopez | 229/41 C |

FOREIGN PATENT DOCUMENTS

| | | | |
|---|---|---|---|
| 1408714 | 10/1975 | United Kingdom | 229/41 C |

*Primary Examiner*—Willis Little

*Attorney, Agent, or Firm*—Milton S. Gerstein

[57] ABSTRACT

A container for dispensing foods and for storing articles is provided with its own integrally-connected closure-lid. The closure-lid has a plurality of first triangular sections alternating with a plurality of second triangular sections. Each second section is foldable along its height. The bases of the first sections are formed integrally with the upper rim of the container portion by fold lines, so that the closure-lid folds inwardly about the fold lines of the bases of the first sections, during which the second sections fold-in upon themselves about the fold lines thereof.

3 Claims, 5 Drawing Figures

CONTAINER WITH INTEGRAL FOLD-IN CLOSURE LID

BACKGROUND OF THE INVENTION

The present invention is directed to a container for liquids and solids which may be used for dispensing the contents thereof, and has particular utility for use in the fast food industry for replacing currently-used paper cups and the plastic lids therefor.

Containers for holding fast food items, such as chicken, cole slaw, salads, pies, cakes, soft drinks, and the like, are typically made of paper or wax-impregnated paper, with a separately-usable and distinct plastic cover lid being used to close off the container for storage, which lid is removed when access to the contents of the container is desired. However, these plastic cover lids are not readily disposeable, contribute considerably to litter, especially since the plastic is not biodegradable. and are made of petrochemicals which come into contact with the contents of the container which it covers.

SUMMARY OF THE INVENTION

It is, therefore, the primary objective of the present invention to provide a container which has therewith its own integrally-formed closure lid made of the same biodegradable material as the container itself.

It is another object of the present invention to provide such an integral closure lid that is easily formed by simply bending over the upper portion of the container.

It is an objective of the present invention to provide such an integral cover lid that replaces the conventional plastic cover lid, thus allowing for reduced spatial requirements during storage and shipping.

It is another objective of the present invention to provide such a container with integral cover lid that, in the end, will allow for improved sanitary conditions in the fast food instrustry, since less contact by food handlers is required.

It is yet another objective of the present invention to provide such a container with integral cover lid such that, when the lid is formed, it will stay in its closure-position without the need of supplemental material, such as glue, mating interconnections, and the like, but will remain in its closure-position by the inherent resiliency of the material itself at the juncture of the closure lid with the container proper.

Toward these and other ends, the container with integral closure lid of the invention is made entirely of paper, wax-impregnated paper, or the like, and includes a main container proper formed integrally with a closure lid portion that is provided with a series of isosceles triangularly-shaped sections. The triangularly-shaped sections are provided in a first series each of which has its apex thereof facing upwardly when the container proper is situated in a vertical orientation, and a second series each of which has its apex facing downwardly, such that an alternate arrangement is provided where a section from the first series is followed by a section from the second series, et seq. Thus, each section of the first series is sandwiched between two sections of the second series, and vice versa. Each section of the second series is also provided with a bisecting fold line extending along the entire height of the respective section. The base of each section of both the first and second series is, preferably, arcuately shaped and convex toward the bottom of the container proper, in order to increase the natural restoring force of the sections so as to urge them toward their original, straight orientations, which provides the inherent force necessary for holding the sections in place after they have been folded down to close off the opening of the container proper, which holding is achieved by the interengagement of the apices of the first series at the center of the opening of the container proper being closed off.

The container proper with integral closure lid thereof is made from one sheet of paper, or the like, with the upper portion of the sheet being formed with the first and second series of sections forming the integral closure lid, which is achieved by stamping impressions on the upper portion of the sheet to form the sections of the first and second series, and forming the bisecting fold lines in the sections of the second series. A hole may also be formed in one of the sections of the first series, which hole may be used for the insertion of a straw.

BRIEF DESCRIPTION OF THE DRAWING

The invention will be more readily understood with reference to the accompanying drawing, wherein.

DETAILED DESCRIPTION OF THE INVENTION

Figure 1:
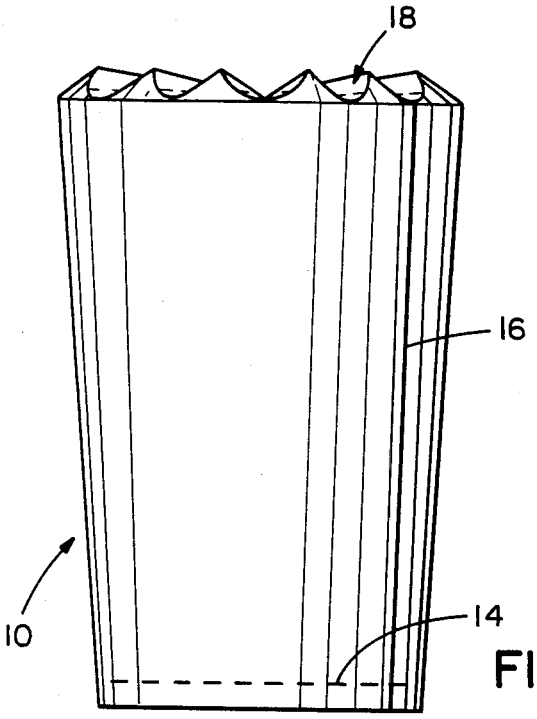
FIG. 1 is a side elevational view of a container with integral closure lid according to the principles of the present invention, with the container shown with the closure lid in its closure-position.
Figure 5:
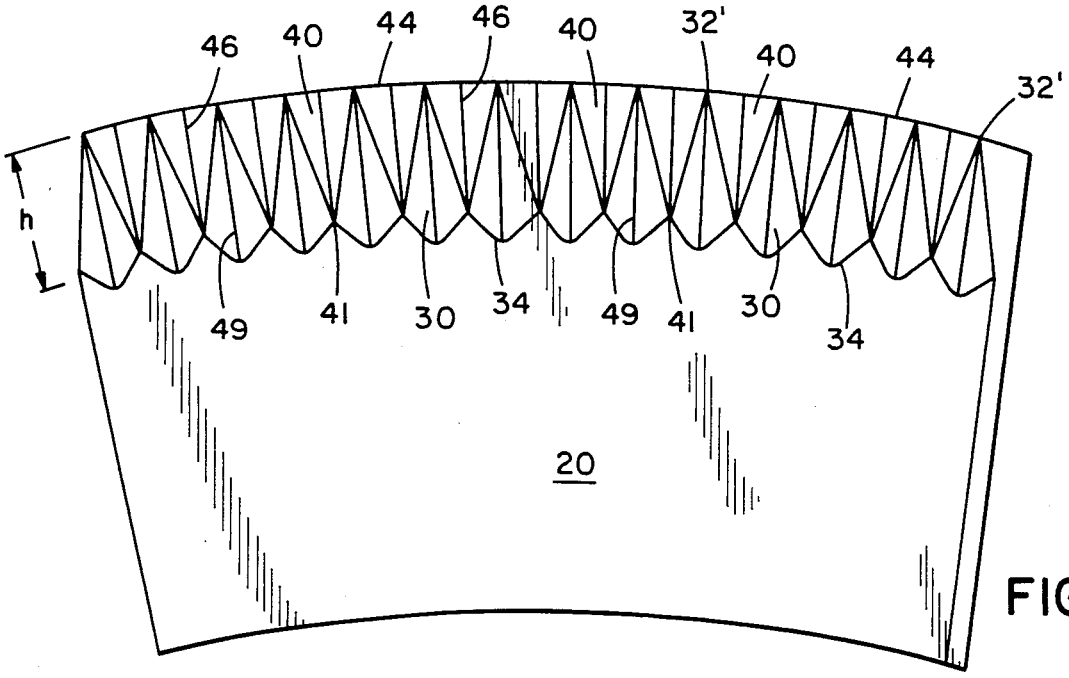
FIG. 5 is a plan view showing the sheet material from which the cup of FIG. 1 is made, which sheet material is provided with the stamped impressions thereof defining the series of sections of the integral closure-lid at the upper portion thereof.

Referring now to the drawing in greater detail, the container with integral closure-lid is indicated generally by reference numeral 10 in FIG. 1. The container 10 is shown as a truncated cone, though it may take the shape of a cylinder, or the like. The container 10 may be used to hold liquid, such as soft drinks, or solids, such as french fries, chicken, cole slaw, or any other item to-be-dispensed thereby. The container is preferably made of paper or wax-impregnated paper, and has a bottom 14 that may or may not be formed from the same piece of material as the remainder of the container 10. The container has a seam 16 by which it is formed from one-piece of sheet material, such as that shown in FIG. 5, and discussed in detail hereinbelow. The container also includes an integral closure-lid or element 18 defining the invention. The closure-lid is formed from the same sheet 20 (see FIG. 5) as the container proper, and is defined by a plurality of substantially iscoseles, triangular-shaped sections. There are two series of these sections, which alternate about the circumference of the closure-lid. The first series includes a plurality of triangular-shaped sections 30, each of which, as best seen in FIG. 5, has its apex facing upwardly, when viewing FIG. 5, when the container is upright. Each section 30 also has a pair of elongated sides 32 of approximately the same length, and an arcuate base 34 connected the sections 30 with the remainder of the container proper at the upper portion thereof. Each base 34 is connected to the adjoining bases of the sections 30 at the ends thereof, so that, when the closure-lid 18 is folded down to its closure-position, for closing off the container, the bases 34 define the upper rim of the container proper, and also define the jointure about which the closure-lid 18 pivots and is bent to alternatively place it in its closure-position or open-position. The bases 34 are shown as arcuate, and substantially convex toward the bottom 14, in order to increase the resilient restoring forces of the closure-lid, so that, when the closure-lid is folded down to its closure-position, the restoring force tends to cause the individual sections 30 to pivot upwardly, so that the apices 32' of the sections 30, meeting at the center 33 of the hollow interior of the container proper, will prevent the sections 30 from pivoting upwardly about the bases 34, to thereby provide a closure-lid that requires extraneous force to separate them and allow for the movement back toward their open-position, as will be described in greater detail hereinbelow.

Figure 2:
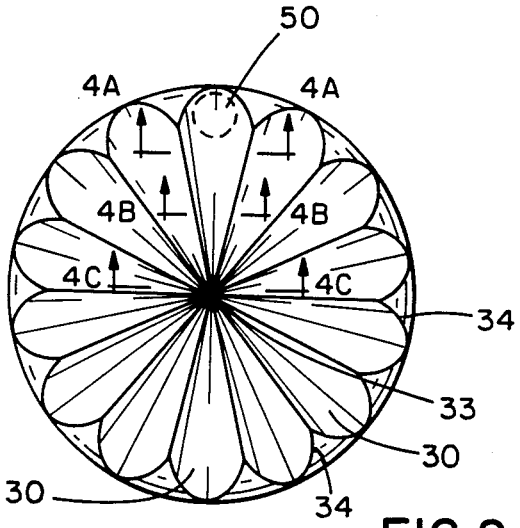
FIG. 2 is a top view of the container with integral closure-lid of FIG. 1.
Figure 4A:
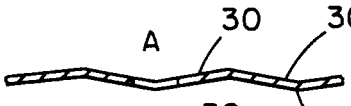
FIG. 4A is a detail, cross-sectional view taken along line 4A—4A of FIG. 2.
Figure 4B:
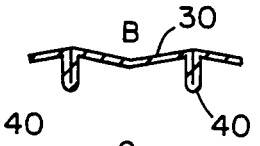
FIG. 4B is a detail, cross-sectional view taken along line 4B—4B of FIG. 2.
Figure 4C:
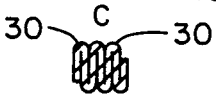
FIG. 4C is a detail, cross-sectional view taken along line 4C—4C of FIG. 2.
Figure 3:
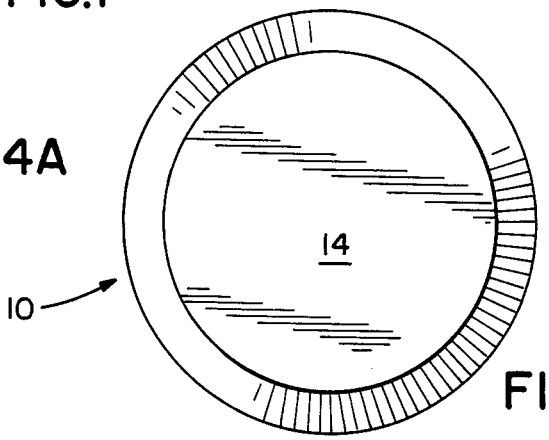
FIG. 3 is a top view of the container of FIG. 1 but with the closure-lid in its vertically-oriented, open position.

The second series of triangular-shaped sections are sections 40, which are positioned between adjacent sections 30 of the first series. Each section 40 of the second series is also an isosceles, triangular-shaped element, but with the apex of each section 40 facing downwardly toward the bottom 14 when the container is upright. Each apex 41 is defined by the joinder of the bases 34 of adjacently-positioned sections 30. The base 44 of each section 40 is substantially straight, or less arcuate, as opposed to the arcuate bases 34 of the sections 30. Each section 40 is also formed with a bisecting fold line 46 along the height of each section. These fold lines 46 allow each section 40 to fold-in upon itself as the closure-lid 18 is pivoted and bent about the bases 34, so that, when the closure-lid 18 is in its closure-position, these sections 40 are not readily visible, as is clear from FIGS. 4B and 4C. The sections 30 are visible when the closure-lid 18 is in its closure-position, shown in FIG. 2.

The sections 30 and 40, along with the fold lines 46, are formed by stamping or impressing these sections into the upper portion of a single sheet of material 20, as shown in FIG. 5. These sections 30 and 40 are formed by fold lines themselves which constitute the legs 32 defining the sides of adjacently-adjoining sections 30 and 40, and the bases 34 of the sections 30. Each section 30 is also preferably provided with its own bisecting fold line 49 for increasing the resiliency of these sections and to allow for easier bending of the closure lid 18. The fold line 49 allows for each section 30 to bend slightly about its height for ease of closing, and also to enhance the restoring force that tends to cause each section back to its neutral, planar orientation relative to the fold line 49. Thus, when the section 30 is bent slightly about the fold line 49, the natural resiliency of the material from which each section is made tends to urge the section back to its flat, planar state, thereby creating a tightly-closed closure-lid. However, use of these fold lines 49 may be eliminated, with ample restoring force being provided via the bases 34 and the juncture thereof with the upper rim of the container proper.

The upper portion of the sheet 20 in which is formed the closure-lid preferably has a height "h" slightly greater than the radius of the opening of the container proper, so that each section 30 also has a height of the triangle thereof of the same measurement. Thus, when the sections are pivoted into the opening to close off the container proper, the apices 32' meet substantially at the center of the opening, and at an elevation slightly below the plane containing therein the upper rim of the container proper, so that these apices prevent the natural restoring forces from causing the sections to pivot upwardly and undesirably open the container proper. The height of each section 30 is only of the order of one or two millimeters greater than the radius of the opening. It is, however, possible to make the height of each section 30 the same as the radius of the opening which they are closing off, since the forward-most portion of each section 40, at the part thereof defined by its base 44, will engage an apex 32' of a section 30 opposite thereto when the sections are bent toward the opening to-be-closed off. Toward this end, each base 44 may be made only slightly arcuate, concave to the bottom 14, so as to enhance this interaction between the apices 32' and the bases 44 when the bases 44 are bent upon themselves to thereby sandwich therebetween the apices 32'. The general type of arrangement is dependent upon the end-use of the container, and the contents to be stored in the container proper.

The surface area defined by the sections 30 is slightly greater than the area defined by the opening of the container proper, to cause slight folding of each section 30 about its fold line 49, as above-described. In actual use, the sections 40 may not all be compleetly folded upon themselves, so that this may be taken into consideration in determining the optimal surface area in total of the sections 30, which may allow for smaller sections 30. Since the sections themselves close off the opening via the apices thereof in conjunction with the folded-over sections 40, no extraneous bonding is necessary, such as glue, or the like. Further, since outward movement of the inwardly-folded sections 30 and 40 tends to be increasingly resisted by the interengaged apices with each other and with the folded-over sections 40, the everting of the container proper, with its contents, does not mean that the contents thereof shall be dispensed, since the weight of the contents, as long as it is not of such proportion as to be destructive, only serves to create greater interengagement of these apices, thereby enhancing the interlocking thereof.

In the preferred embodiment, twelve such sections 30 are provided, although any number of such sections may be used along with equal numbers of fold lines 46. The container 10 is most advantageous for use in the fast food industry, where it is used only once, since repeated use of the closure-lid reduces its closure-qualities since the natural resiliency of the material deteriorates. The container may, however, be made of aluminum, in which case repeated use would be more practicable. Further, in the case of the container 10 when it is storing liquid, a circular, perforated portion 50 may be provided for the forced insertion therethrough of a straw. The portion 50 may also be punched out and used for dispensing small particles stored in the container proper. The container 10 may also be used as boxes for gift items. or as shipping tubes, with the appropriate material being chosen therefor. While a specific embodiment of the invention has been shown and described, it is to be understood that numerous changes and modifications may be made therein without departing from the scope and spirit of the invention as defined by the appended claims.

What is claimed is:

1. A container for holding and dispensing liquids and solids, comprising:

a main container portion defining a hollow cavity in which material to be dispensed is stored, said main container portion having a bottom portion and an upper rim portion defining the mouth of a container;

an inwardly-foldable closure-lid portion, said closure-lid portion having a peripheral base portion connected to said upper rim portion, said base portion being pivotal relative to said rim portion so that said closure-lid portion may be folded inwardly to close off the mouth of said container portion;

said closure-lid portion comprising a first series of substantially triangular-shaped sections, each said section of said first series comprising a pair of sides and a base, the bases of said sections of said first series defining said peripheral base portion of said closure-lid portion connected to said upper rim portion, each said section of said first series defining a first apex thereof facing away from said upper rim portion;

a second series of substantially triangular-shaped sections, each said section of said second series comprising a pair of sides and a base, the bases of said sections of said second series defining an outer edge portion of said closure-lid portion when said closure-lid portion is in its open-position to allow dispensing and filling of the container, each said section of said second series defining a second apex;

said sections of said first series alternating with said sections of said second series about said closure-lid portion such that a section from said first series is positioned between a pair of sections of said second series, and a section from said second series is positioned between a pair of sections of said first series;

each said section of said second series having a first fold line to allow for the folding thereof when said closure-lid portion is folded inwardly to close off the mouth of the container;

each said section of said first series having a height thereof slightly greater than the radius of said mouth of said container portion, so that said apex of each section of said first series, when said first series is positioned in the mouth of said container portion, lies in a plane spaced from a plane containing therein said upper rim portion of said container portion, said plane of said apex lying closer to said bottom portion of said container portion than said upper rim portion;

each said section of said first series having a second fold line extending substantially along the height thereof parallel to said first fold line when said sections are in their open state; each said first fold line of said sections of said second series bisecting the respective triangle thereof along the entire height thereof from the respective said second apex to the respective said base thereof, said pair of sides of each said section of said second series defining third and fourth fold lines with directly adjacent sections of said first series, each said third and fourth fold lines extending from the respective said apex of the respective said section of said second series to the respective said base of the respective said section of said second series, whereby added strength and holding force is provided to said closure-lid portion;

each said base of each said section of said first series having a fifth fold line thereof, each said fifth fold line being arcuate in shape to aid in the folding-in of said sections of said first series to close off said mouth of said container portion.

2. The container according to claim 1, wherein said closure lid portion further comprises a perforated section formed in at least of one of said first sections through which may be passed a straw, or the like.

3. The container according to claim 1, wherein each said fifth fold-line is substantially concave in shape.

* * * * *